United States Patent [19]

Shelton et al.

[11] 4,156,827

[45] May 29, 1979

[54] MATRIX CATHODE CHANNEL IMAGE DEVICE

[75] Inventors: Joe Shelton; Jerry W. Hagood; Ralph L. Norman, all of Huntsville, Ala.

[73] Assignee: The United States of America as represented by the Secretary of the Army, Washington, D.C.

[21] Appl. No.: 916,642

[22] Filed: Jun. 19, 1978

[51] Int. Cl.[2] ..... H01J 39/14; H01J 43/06

[52] U.S. Cl. ..... 313/95; 313/102; 313/105 CM

[58] Field of Search ..... 313/105 CM, 95, 102

[56] References Cited

U.S. PATENT DOCUMENTS

| | | | |
|---|---|---|---|
| 2,128,104 | 8/1938 | Thomas | 313/95 |
| 2,307,035 | 1/1943 | Gabor | 313/95 X |
| 3,407,324 | 10/1968 | Rome | 313/95 |
| 3,681,606 | 8/1972 | Tinney | 313/105 CM X |
| 3,814,968 | 6/1974 | Nathanson et al. | 313/95 |
| 3,825,922 | 7/1974 | Ralph | 313/105 CM X |
| 3,840,955 | 10/1974 | Hagood et al. | 29/25.18 |
| 3,866,078 | 2/1975 | Norman et al. | 313/377 |
| 3,878,426 | 4/1975 | Norman et al. | 313/376 |
| 3,898,499 | 8/1975 | Nagao et al. | 313/95 X |
| 3,902,240 | 9/1975 | Chang et al. | 313/95 X |

*Primary Examiner*—Palmer C. Demeo

*Attorney, Agent, or Firm*—Nathan Edelberg; Robert P. Gibson; Robert C. Sims

[57] ABSTRACT

This device uses an oxide-metal matrix material to enable the integration of either constant or pulsed image readout without the use of electron scanning. It takes advantage of a new materials's ability to serve as both a field effect emitter and a matrix channel for the emitted electrons to enable improved resolution.

1 Claim, 2 Drawing Figures

MATRIX CATHODE CHANNEL IMAGE DEVICE

DEDICATORY CLAUSE

The invention described herein may be manufactured, used, and licensed by or for the Government for governmental purposes without the payment to us of any royalties thereon.

BACKGROUND OF THE INVENTION

In recent years, the many requirements of the military services and the civilian population for better image detection devices has placed great incentives on imaging technology. Following the Second World War, gigantic strides were made in all the technology best called electro-optical photography. The military services constantly faced with man's visual limitations at night, have been instrumental in increasing research and development in imaging devices. The technology has presently been extended well into low-light-level environments and is both militarily and scientifically productive in conditions of reduced lighting. A most comprehensive review of the technology appears in *Electro-Optical Photography at Low Illumination Levels* by Harold V. Soule (New York: John Wiley & Sons, 1968).

Despite the advances accomplished in electro-optical photography vast improvements remain possible. There are numerous areas such as power requirements, size, photon efficiency, weight, image quality, etc., wherein improvements would enhance military capability and extend scientific usefulness. Military night vision and low-light-level television devices yet fall far short of the desired goals.

DESCRIPTION OF THE PREFERRED EMBODIMENT

Advantages of the Matrix Cathode Channel Image Device are:

1. This matrix cathode channel image device enables the receipt, integration, retention and intensification of a photon or electron image without the use of any electron scan mechanism. The ability of this device to integrate and retain an image until it is read out will improve low-light-level performance.

2. The device enables image readout in a continuous or pulsed mode without the use of an electron beam scan mechanism.

3. The device enables greater resolution because of the reduced effects of the tangential velocity of electrons emitted from the photocathode and the ultrafine channels in the ceramic material.

4. Since the metallic fibers remain biased at all times, electron migration within the photocathode is reduced which increases resolution.

5. The device may be operated in a pulsed mode in synchronization with a recording device such as light sensitive films to take advantage of the integration and storage capabilities of the device to enhance performance under low-light-level conditions.

6. The ability of the device to be pulse operated enables the selection of the phosphor's persistency and the pulse timing readout to be matched more exactly to reduce image smearing. This would be of considerable photographic value.

7. The image out may be selected to be either a photon image or an electron image.

Figure 1:
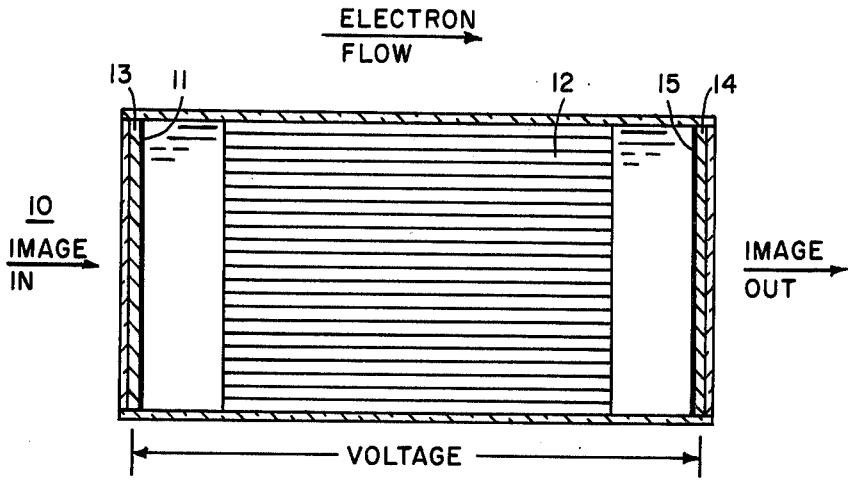
FIG. 1 shows the basic concept of an image intensifier.

A sketch of a basic device is shown in FIG. 1. The light image 10 enters the channel image-intensifier from the left falling on a photocathodic (photoemissive) material 11 deposited on the inside of the device. The photo-emitted electrons enter the glass tubes 12 by the influence of the voltage imposed on the conductors 13 and 14 at each end of the image device. The glass tubes are designed to amplify the number of entering electrons by having the inside surfaces of the tubes coated with a material which when struck by an electron re-emits more than one electron. In this manner the number of electrons released initially by the photon input is greatly multiplied by the electron cascading in the tubes to give a greatly amplified image output at the phosphor coating 15. Under certain conditions the image output could be useful as electrons directly and would not be converted back to a photon output.

This type imaging device suffers from certain defects not the least of which is that glass (or ceramic) tubes of extremely small size must be produced and coated inside uniformly and then bundled together in a useable matrix. The present state-of-the-art tends to limit this size to not much less than one millimeter inside diameter. The matrix cathode channel image device takes advantage of the characteristics of a new oxide-metal composite material to greatly lessen the disadvantages of the larger glass tubes.

This new oxide-metal matrix material has been recently developed to a rather high state-of-art. The material production process begins with carefully measured ratios of a metallic oxide and a metal different from that of the oxide both finely powdered and well mixed. This powder mixture confined in a high melting point crucible is heated extensively in a rf zone-refining type furnace. The resulting material is matrix in nature with the metal forming fine continuous fibers in the oxide. This material has several properties which are of considerable interest electrically:

a. the fibers are continuous,
b. the fibers are conductive,
c. the material may be processed mechanically,
d. the material may be processed chemically,
e. the material is electrically bondable to other conductors, etc.

The material may be processed such that the metallic fibers extend beyond the oxide surface or are below the oxide surface. The metallic fibers may be blunt, round or sharp pointed depending upon the chemical processing selected. The growing process for this material is controllable such that one million to a few million fibers (rods) per square centimeter are produced. The fibers produced are fractions of a micron in diameter and it is this property which allows the vast improvement in channel diameter reduction.

This material has proved almost ideal as a field effect emitter. This is to say that upon application of the proper strength electric field electrons evolve from the metallic fibers at ambient temperature.

Figure 2:
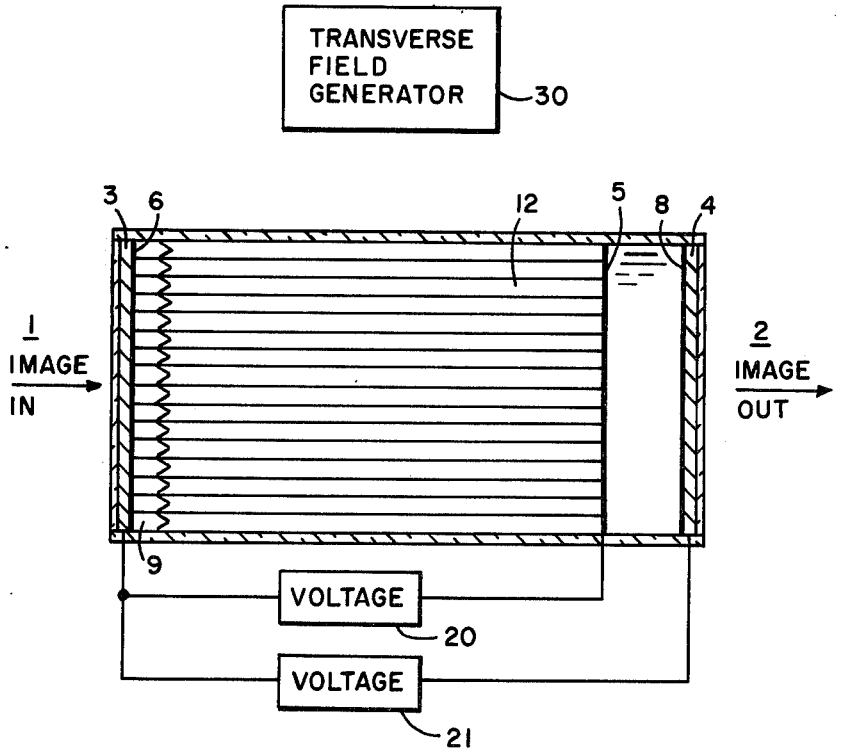
FIG. 2 is a schematic and diagrammatic showing of the preferred embodiment of the present invention.

It is the sum combination of properties of this unique material which makes possible the matrix cathode channel image device shown in FIG. 2. The image 1 as either photons or electrons enters the device which allows prior image processing by any desired optical system as is the case for any other imaging device. The processed image leaves the device at 2. The processed image may leave the device as a photon image or as an electron image depending upon the type image desired and the phosphor or other material selected to focus the image on. This allows the image to be received by a human eye or other sensitive medium or it allows the device to be stacked so as to increase the amplification of the image input.

Conductors 3 and 4 permit a voltage to be imposed across the device in the same manner as is done in FIG. 1. The negative pole is connected to the conductor 3 and the positive pole is connected to the conductor 4. Electrons are supplied 3 and any electrons freed are drawn toward 4. To obtain a more critical control of the electrons freed and to enable image storage and pulsed readout, conductor 5 may be biased very slightly positive to conductor 3 by voltage 20 however, conductor 5 remains negative to conductor 4.

A light or electron image entering the tube passes through film conductor 3 and has its energy absorbed by the photocathode material 6 (or a material which emits more electrons when struck by electrons). The electrons released by this energy find themselves under the electric force originating from the conductors 5 and, if the full voltage 21 is active, the electric force from the conductors 4 and 5.

It is here that one of the great advantages of this device occurs. Normally, an electron released from the photocathodic material 6, is released with some tangential velocity to the desired electron flight path indicated 7. In this device, the metal-oxide matrix material at point 9 is faced directly to the photocathode material at point 6. This means that any electron emitted by the photocathodic material is at once distance wise captured by the metal in the metal-oxide matrix 9. (The metal-oxide matrix has from one million to approximately seven million conducting fibers per square centimeter available to capture any freed electrons.)

Once an electron is captured in a metallic fiber 9, it is drawn to the tip of the fiber by the electric field forces generated by voltage 20. If the device has the full operating potential 21 imposed, the electron is freed from the fiber and begins its journey down the superfine channels of the ceramic tube matrix 12. The first time each electron collides with a tube wall, electron multiplication takes place with the end result being image amplification. The extent of amplification may be even further increased by the application of a magnetic field or a transverse electric field from field generator 30 to increase the number of electron collisions with the channel walls.

If only the bias voltage 20 is applied, the electron remains on the metallic fiber until the full potential 21 is applied, at which time an image formed by all the electrons released and retained is formed on the phosphor coating 8. An alternate way to control image pulsing is to leave the high voltage on the conductor 4, and adjust this voltage to just below the potential required to cause field effect emission from the metal pins in the metal-oxide matrix 9. The potential is then increased to the amount needed to cause field effect emission by further biasing of conductor 5.

The complete cycle now is: a photon or electron image is received as an image input, the photocathode releases electrons which are captured by the metal fibers in the metal-oxide matrix, these electrons are emitted under the electric field, travel down the ceramic tubes causing electron multiplication and on to the phosphor plate to form an image there. The ambient temperature matrix cathode and conductor 5 may take the shape shown in our U.S. Pat. No. 3,840,955, Oct. 15, 1974.

We claim:

1. In an image intensifier for intensifying an input image to an output image, the improvement comprising a first means for receiving said input image and converting it into electrons representative of the image; a matrix cathode faced directly to said first means so as to receive said electrons representing said image without any tangential scattering of the electrons; said matrix cathode being a thin sheet of oxide metal composite having several million parallel metal fibers per square centimeter posed normal to the sheet surfaces for conducting electrons between surfaces of said sheeet and operating at an ambient temperature; first and second conductors; said first conductor being connected to said matrix cathode; a ceramic tube matrix located adjacent to said matrix cathode; second means located spacially from said matrix cathode and said tube matrix so as to receive the electrons emitted from said matrix cathode and to produce the output image; said second conductor being connected to said second means; first voltage means connected between said first and second conductors providing a voltage differential between said matrix cathode and said second means so as to cause the electrons to travel from said matrix cathode to said second means; a third conductor connected to a side of the tube matrix opposite that of the side said matrix cathode is connected to; a second voltage means connected between said first and third conductors so as to provide a voltage differential which is considerably less than the voltage differential between said first and second conductors; said first voltage being selectively applied across said first and second conductors so as to selectively provide the output image; an electric field generator; and said generator generating an electric field which is transverse to said tube matrix, so as to increase the number of collisions of the electrons in the ceramic tube matrix.

* * * * *